US008998667B2

(12) United States Patent
Malcom

(10) Patent No.: US 8,998,667 B2
(45) Date of Patent: Apr. 7, 2015

(54) PERSONAL FLOATATION DEVICE HAVING SELECTIVELY INFLATABLE BLADDERS

(76) Inventor: Adam J. Malcom, Charlottesville, VA (US)

( * ) Notice: Subject to any disclaimer, the term of this patent is extended or adjusted under 35 U.S.C. 154(b) by 576 days.

(21) Appl. No.: 12/302,236

(22) PCT Filed: May 23, 2007

(86) PCT No.: PCT/US2007/012372

§ 371 (c)(1),
(2), (4) Date: Jul. 8, 2009

(87) PCT Pub. No.: WO2007/139875

PCT Pub. Date: Dec. 6, 2007

(65) Prior Publication Data

US 2010/0120306 A1 May 13, 2010

Related U.S. Application Data

(60) Provisional application No. 60/802,866, filed on May 23, 2006.

(51) Int. Cl.

| | |
|---|---|
| ***B63C 9/125*** | (2006.01) |
| ***B63C 9/08*** | (2006.01) |
| ***B63C 9/105*** | (2006.01) |
| ***B63C 9/15*** | (2006.01) |

(52) U.S. Cl.
CPC ..... *B63C 9/08* (2013.01); *B63C 9/1055* (2013.01); *B63C 9/1255* (2013.01); *B63C 9/155* (2013.01)

(58) Field of Classification Search
CPC ..... B63C 9/15; B63C 9/1555
USPC ..... 441/92–94, 96, 99, 101, 108, 113
See application file for complete search history.

(56) References Cited

U.S. PATENT DOCUMENTS

| | | | | | |
|---|---|---|---|---|---|
| 346,332 | A | * | 7/1886 | vaughan | 441/111 |
| 1,397,248 | A | | 11/1921 | Framtz | |
| 2,313,151 | A | | 3/1943 | Johnson | |
| 2,615,182 | A | * | 10/1952 | Podell | 441/113 |
| 2,621,342 | A | | 12/1952 | Boyle | |
| 3,130,424 | A | * | 4/1964 | Santangelo | 441/94 |
| 3,452,374 | A | * | 7/1969 | Turner | 441/89 |
| 4,626,221 | A | | 12/1986 | Rocco | |
| 4,925,418 | A | | 5/1990 | Mariotto nee Amiel | |
| 5,500,952 | A | | 3/1996 | Keyes | |
| 5,702,279 | A | * | 12/1997 | Brown | 441/108 |
| 5,879,213 | A | | 3/1999 | Williams, Jr. et al. | |
| 5,954,556 | A | | 9/1999 | Powers | |
| 7,854,347 | B2 | * | 12/2010 | Wang | 222/5 |

OTHER PUBLICATIONS

West Marine "Comfort Series Automatic Inflatable Life Vests", Model No. 8678963, dated May 2, 2009, www.westmarine.com.
West Marine "Comfort Series Manual Inflatable Belt Pack", Model No. 9424938, dated May 2, 2009, www.westmarine.com.

* cited by examiner

*Primary Examiner* — Edwin Swinehart
(74) *Attorney, Agent, or Firm* — MacMillan, Sobanski & Todd, LLC

(57) ABSTRACT

A personal floatation device includes a housing and a plurality of bladders disposed within the housing. The plurality of bladders are movable between a non-deployed position within the housing and extendable from the housing to a deployed position. A device is provided for selectively filling the bladder with a substance that is buoyant in water and causing the bladder to be moved from the non-deployed position to the deployed position. The bladder filling and deploying mechanism can be a cartridge that contains a supply of a compressed gas.

4 Claims, 6 Drawing Sheets

PERSONAL FLOATATION DEVICE HAVING SELECTIVELY INFLATABLE BLADDERS

CROSS-REFERENCE TO RELATED APPLICATIONS

This application is the National Phase of International Application PCT/US07/012,372 filed May 23, 2007 which designated the U.S. and that International Application was published in English under PCT Article 21(2) on Dec. 6, 2007 as International Publication Number WO 07/139875A1. PCT/US07/012,372 claims priority to U.S. Provisional Application No. 60/802,866, filed May 23, 2006. Thus, the subject nonprovisional application claims priority to U.S. Provisional Application No. 60/802,866, filed May 23, 2006. The disclosures of both applications are incorporated herein by reference.

BACKGROUND OF THE INVENTION

This invention relates in general to personal floatation devices, commonly referred to as life vests or life jackets. In particular, this invention relates to an improved structure for such a personal floatation device that includes a belt-like structure containing a plurality of selectively inflatable bladders.

Personal floatation devices are well known in the art and are adapted to be worn by a user to keep the user afloat in a body of water to prevent drowning. To accomplish this, a typical personal floatation device supports or contains a material that is sufficiently buoyant in water as to keep the user afloat. A wide variety of personal floatation devices are known in the art for performing this general function.

Although known personal floatation devices have been successfully engineered to address the needs of users when floating in the water, it appears that little attention has been given to the design of such personal floatation devices when they are worn by users out of the water. On the contrary, many personal floatation devices are relatively uncomfortable to wear and significantly restrict the free movement of the arms and torso of the users wearing them. Consequently, many people simply do not wear their personal floatation devices when engaged in water activities until an emergency situation arises. Unfortunately, during such an emergency situation, it may be difficult to quickly locate and don the personal floatation device. Thus, it would be desirable to provide an improved structure for such a personal floatation device that is relatively comfortable to wear when not in use.

SUMMARY OF THE INVENTION

This invention relates to an improved structure for a personal floatation device that includes a belt-like structure containing a plurality of selectively inflatable bladders. When the user is not in the water, the bladders can be rolled up and stored within the personal floatation device as to provide the user with significant maneuverability, near normal air circulation, and a minimum amount of discomfort. When needed for use, however, the bladders can be inflated with a gas or otherwise filled with a buoyant material, either manually or automatically. During such inflation, the bladders are extended from the personal floatation device around the user to provide a personal floatation device that supports the user in a body of water.

Various objects and advantages of this invention will become apparent to those skilled in the art from the following detailed description of the preferred embodiments, when read in light of the accompanying drawings.

DETAILED DESCRIPTION OF THE PREFERRED EMBODIMENTS

Figure 1:
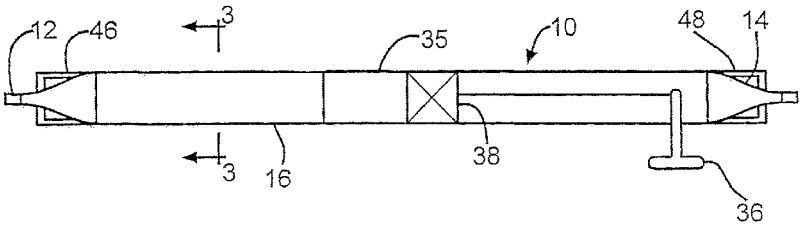
FIG. 1 is a side elevational view of a personal floatation device that includes a belt-like structure containing a plurality of selectively inflatable bladders in accordance with a first embodiment of the invention.
Figure 2:
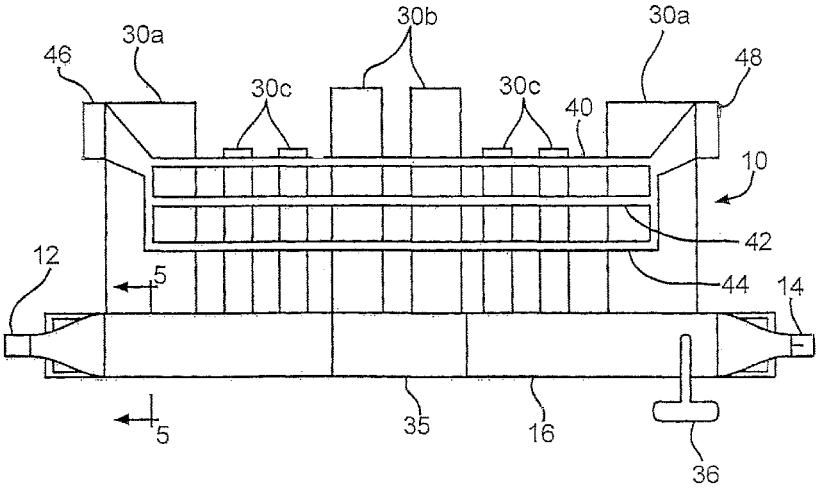
FIG. 2 is a side elevational view similar to FIG. 1 showing each of the plurality of bladders in an inflated and deployed position extending from the personal floatation device.
Figure 3:
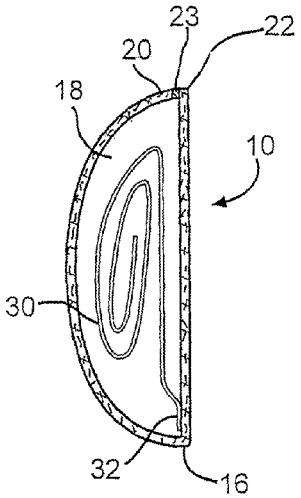
FIG. 3 is a sectional view taken along the line 3-3 of FIG. 1 showing one of the plurality of bladders in a deflated and non-deployed position within the personal floatation device.
Figure 5:
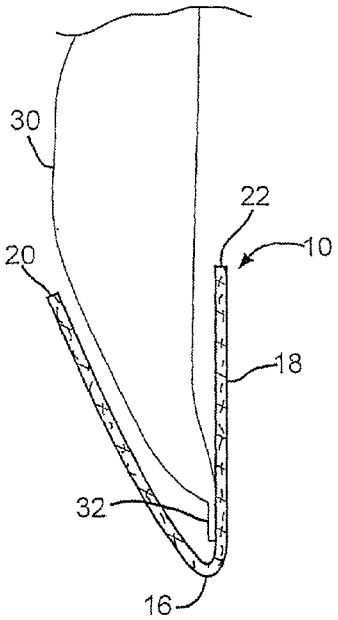
FIG. 5 is a sectional view taken along the line 5-5 of FIG. 2 showing one of the plurality of bladders in the inflated and deployed position extending from the personal floatation device.

Referring now to the drawings, there is illustrated in FIGS. 1 and 2 a personal floatation device, indicated generally at 10, in accordance with this invention. The illustrated personal floatation device 10 includes a housing that is shaped generally in the form of a belt, being relatively long and narrow in shape. However, the personal floatation device 10 may be formed having any desired shape. The illustrated personal floatation device 10 has first and second fastening devices 12 and 14 provided at opposite ends thereof. The first and second fastening devices 12 and 14 are adapted to selectively cooperate with one another to releasably secure the personal floatation device 10 about a user in the manner of a belt. To accomplish this, the fastening devices 12 and 14 may be embodied as any conventional type of releasable cooperating fasteners that are well known in the art, such as are commonly used on a variety of known personal floatation devices. If desired, the personal floatation device 10 may include a conventional length adjustment structure (not shown) to facilitate use thereof by persons having different body sizes, again as well known in the art.

The structure of the personal floatation device 10 is more clearly illustrated in FIG. 2. As shown therein, the personal floatation device 10 can be formed from an elongated strip of material that is folded lengthwise along a bottom edge 16 to form a generally U-shaped or V-shaped internal pocket 18. Edges 20 and 22 of the strip of material are releasably secured together to close the upper end of the pocket 18. To accomplish this, one or both of the edges 20 and 22 of the strip of material can be provided with a conventional fastening mechanism 23. The fastening mechanism 23 can, for example, be embodied as a strip of conventional hook and loop material. The personal floatation device 10 can alternatively be formed from multiple pieces of material that are sewn or otherwise secured together.

Within the pocket 18 of the personal floatation device 10, a plurality of bladders 30 is provided. One of the plurality of bladders 30 is shown in FIG. 2 within the personal floatation device 10 in a deflated and non-deployed position. Preferably, each of the deflated and non-deployed bladders 30 is rolled up or folded within the personal floatation device 10 in such a manner as to facilitate inflation and deployment in the manner described in detail below. Each of the bladders 30 is sewn or otherwise secured to the personal floatation device 10, such as shown at 32.

Referring back to FIG. 1, it can be seen that the personal floatation device 10 also includes a device, indicated generally at 35, for selectively inflating and deploying each of the bladders 30. In the illustrated embodiment, this bladder inflating and deploying mechanism 35 includes an actuator 36 for selectively initiating the operation thereof. In the illustrated embodiment, the actuator 36 for the bladder inflating and deploying mechanism 35 is a manually operable pull lever. The illustrated pull lever 36 is provided on the personal floatation device 10 adjacent to one end thereof. As a result, when the personal floatation device 10 is worn by a user, the pull lever 36 is positioned at or near the front of the user for easy accessibility and use. Alternatively, the actuator 36 may be embodied as an automatic sensing device that is responsive to a predetermined condition or plurality of conditions for automatically initiating the operation of the bladder inflating and deploying mechanism 35 without any manual input from the user wearing the personal floatation device 10. For example, the automatic sensing device may any conventional sensor that is responsive to the presence of water or to the presence of a predetermined magnitude of pressure for initiating the operation of the bladder inflating and deploying mechanism 35.

The illustrated bladder inflating and deploying mechanism 35 further includes a bladder filling device 38 that is responsive to operation of the actuator 36 filling each of the bladders 30 with a substance that is buoyant in water. In the illustrated bladder filling device 38 is a cartridge that contains a supply of a compressed gas, such as carbon dioxide gas. However, the bladder filling device 38 may be embodied as any conventional mechanism that is capable of selectively filling each of the bladders 30 with a substance that is buoyant in water. Preferably, the bladder filling device 38 is supported on the outside of the personal floatation device 10 and near the middle thereof. As a result, the bladder filling device 38 will normally be positioned at or near the center of the back of the user where it will not normally impede his or her movements. However, the bladder filling device 38 may be provided at any desired location on the personal floatation device 10. Alternatively, the bladder filling device 38 may be provided as a stand alone unit that is separate from the personal floatation device 10.

Figure 4:
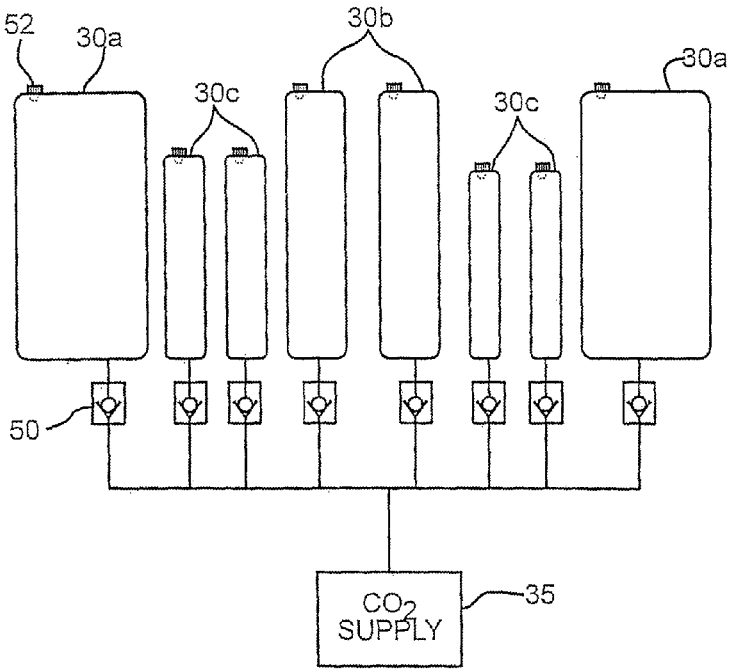
FIG. 4 is a schematic view of a pneumatic actuating circuit that is contained within the personal floatation device for deploying the plurality of bladders shown in FIG. 3.

When it is desired to deploy the plurality of bladders 30 of the personal floatation device 10 for use, the actuator 36 of the bladder inflating and deploying mechanism 35 is initially operated, either by manually pulling the pull lever 36 or automatically as described above. This causes the bladder filling device 38 to fill each of the plurality of bladders 30 with a substance that is buoyant in water. When this occurs, the bladders 30 are inflated and deployed so as to extend from the personal floatation device 10, as shown in FIGS. 2 and 4. The bladders 30 can be formed having any desired cross-sectional shape, but are preferably of circular, semi-circular, or oval in cross-sectional shape. Regardless of their specific sizes and shapes, the bladders 30 are adapted to provide a desired amount of buoyancy for a user.

As shown in FIGS. 2 and 4, the plurality of bladders 30 may be formed having different sizes. In the illustrated embodiment, the plurality of bladders 30 includes a group (two in the illustrated embodiment) of first bladders 30*a*, a group (two in the illustrated embodiment) of second bladders 30*b*, and a group (four in the illustrated embodiment) of third bladders 30*c*. The first bladders 30*a* are located at or near the opposite ends of the illustrated personal floatation device 10. Thus, when the personal floatation device 10 is worn by a user, the first bladders 30*a* are located adjacent to one another at the front of the torso of the user. The second bladders 30*b* are located adjacent to one another at or near the center of the illustrated personal floatation device 10. Thus, when the personal floatation device 10 is worn by a user, the second bladders 30*b* are located adjacent to one another at the rear of the torso of the user. A first pair of the third bladders 30*c* are located between one of the first bladders 30*a* and the second pair of bladders 30*b*, and a second pair of the third bladders 30*c* are located between the other of the first bladders 30*a* and the pair of second bladders 30*b*. Thus, when the personal floatation device 10 is worn by a user, the third bladders 30*c* are located at the opposite sides of the torso of the user.

Preferably, the first and second bladders 30*a* and 30*b* are the largest of the plurality of bladders 30 and, therefore, perform the bulk of the buoyancy function of the personal floatation device 10 when the personal floatation device 10 is worn by a user. The third bladders 30*c* are preferably relatively short in length in relation to the first and second bladders 30*a* and 30*b* so that the third bladders 30*c* fit comfortably beneath the arms when the personal floatation device 10 is worn by a user. However, as mentioned above, the plurality of bladders 30 can be formed having any shapes and sizes, as well as any desired combination thereof.

As also shown in FIG. 2, one or more straps (such as the illustrated three straps 40, 42, and 44), may be secured to some or all of the plurality of bladders 30. The straps 40, 42, and 44 are conventional in the art and are provided to maintain the plurality of bladders 30 in a desired relative alignment (such as generally parallel to one another, as shown in the illustrated embodiment) and also to urge the plurality of bladders 30 in engagement with the torso of the user. The straps 40, 42, and 44 can be formed from any desired material and may be secured to the plurality of bladders 30 in any desired manner. Alternatively, adjacent ones of the plurality of bladders 30 may be secured directly together to accomplish this.

The first bladders 30*a* that are located near the opposed ends of the personal floatation device 10 may be provided with cooperating securement structures 46 and 48. Like the first and second fastening devices 12 and 14 described above, the cooperating securement structures 46 and 48 are adapted to selectively cooperate with one another to releasably secure the personal floatation device 10 to a user, in the manner of a vest. In the illustrated embodiment, the cooperating securement structures 46 and 48 are two halves of a conventional zipper. However, the cooperating securement structures 46 and 48 may be formed having any desired structure.

FIG. 4 is a schematic view of a pneumatic actuating circuit that is contained within the personal floatation device 10 for deploying the plurality of bladders 30 as shown in FIG. 2. The pneumatic actuating circuit includes a plurality of one-way valves 50 are respectively connected between the bladder inflating and deploying mechanism 35 and each of the individual bladders 30. In the illustrated preferred embodiment, an individual one of the plurality of one-way valves 50 is associated with a respective one of the plurality of bladders 30. Thus, if one of the plurality of bladders 30 leaks or otherwise fails, it is isolated from the other bladders 30, which will remain inflated. If desired, each of the plurality of bladders 30 may be provided with a deflation valve 52. The deflation valves 52 can provide a convenient mechanism for deflating the plurality of bladders 30 following use so that they can be folded back into the personal floatation device 10 for reuse.

Figure 6:
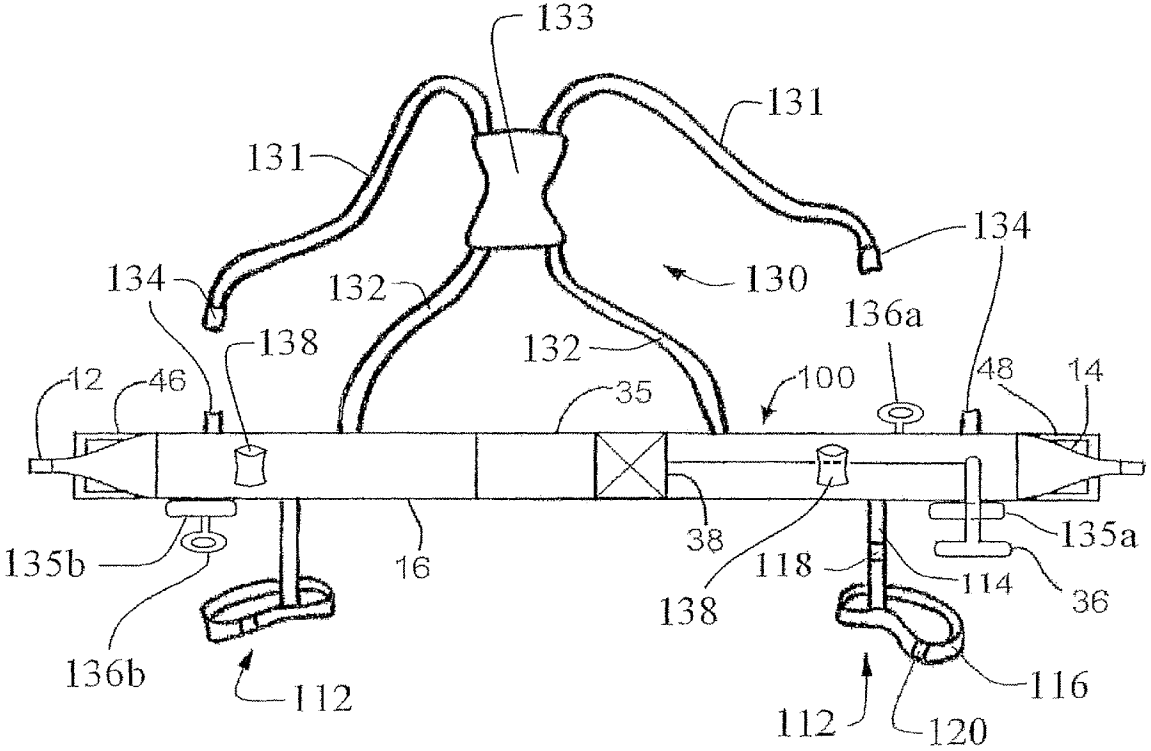
FIG. 6 is a side elevational view of a personal floatation device that includes a belt-like structure containing a plurality of selectively inflatable bladders, a pair of leg securing straps, and a torso securing harness in accordance with a second embodiment of the invention.

Referring now to FIG. 6, there is illustrated a second embodiment of a personal floatation device, indicated generally at 100. The basic structure and operation of the second embodiment of the personal floatation device 100 are similar to the first embodiment of the personal floatation device 10 described above, and like reference numbers are used to indicate similar structures.

The personal floatation device 100 preferably includes a pair of spaced apart leg strap assemblies, indicated generally at 112. The leg strap assemblies 112 provide a secondary attachment structure to secure the personal floatation device 100 to the user. The leg strap assemblies 112 facilitate maintaining the mounted position of the personal floatation device 100, preferably around the user's waist, in the event the user enters the water head-first or feet-first. Each of the illustrated leg strap assemblies 112 includes a strap extension 114 and a leg loop 116. Alternatively, the leg strap assembly 112 may include only a single leg loop 116 fastened to the personal floatation device 100. The strap extensions 114 may be a single element such as, for example a fabric strip or a cable, or alternatively a plurality of elements connected together by a length adjustment device 118, such as a buckle or a hook and loop fastener. The strap extensions 114 may be secured to the leg loops 116 in any desired manner, such as by stitching or by providing a loop at the end thereof through which the leg loop 116 passes. The leg loop 116 is preferably a single strap having an adjustment device 120 to allow the loop to be closed around the user's leg with any desired fit. Alternatively, the leg loop 116 may be a single loop and may include an elastic characteristic, if desired.

The personal floatation device 100 may further include a torso strap, indicated generally at 130. The illustrated torso strap 130 includes a pair of shoulder straps 131 and a pair of anchoring straps 132 that are attached to the housing portion of the personal floatation device 100. The pair of shoulder straps 131 and the pair of anchoring straps 132 are preferably joined together by a tie patch 133, although such is not required. The shoulder strap 131 and the anchoring strap 132 on each side of the personal floatation device 100 may be separate pieces or each side may be one continuous piece. Alternatively, the torso strap 130 may be any structure capable of supporting and maintaining the position of the personal floatation device 100 on the user. The torso strap 130 includes cooperating fasteners 134 that are shown located at each end of the shoulder straps 131 with the mating ends shown slightly inboard of the cooperating securement structures 46 and 48. However, the cooperating fasteners 134 may be located anywhere on the personal floatation device 100.

The personal floatation device 100 may further include a pair of inflation canisters 135*a* and 135*b* that are activated by pull cords 136*a* and 136*b*, respectively, shown in FIG. 6. The canisters 135*a* and 135*b* may be adapted to selectively inflate the various individual bladders 30 or various bladder sections contained within the embodiments of the personal floatation device as will be described in detail below. The personal floatation device 100 may also include at least one holster 138 adapted to contain various items such as rescue signaling devices, extra air cylinders, communications equipment, and the like.

Figure 7:
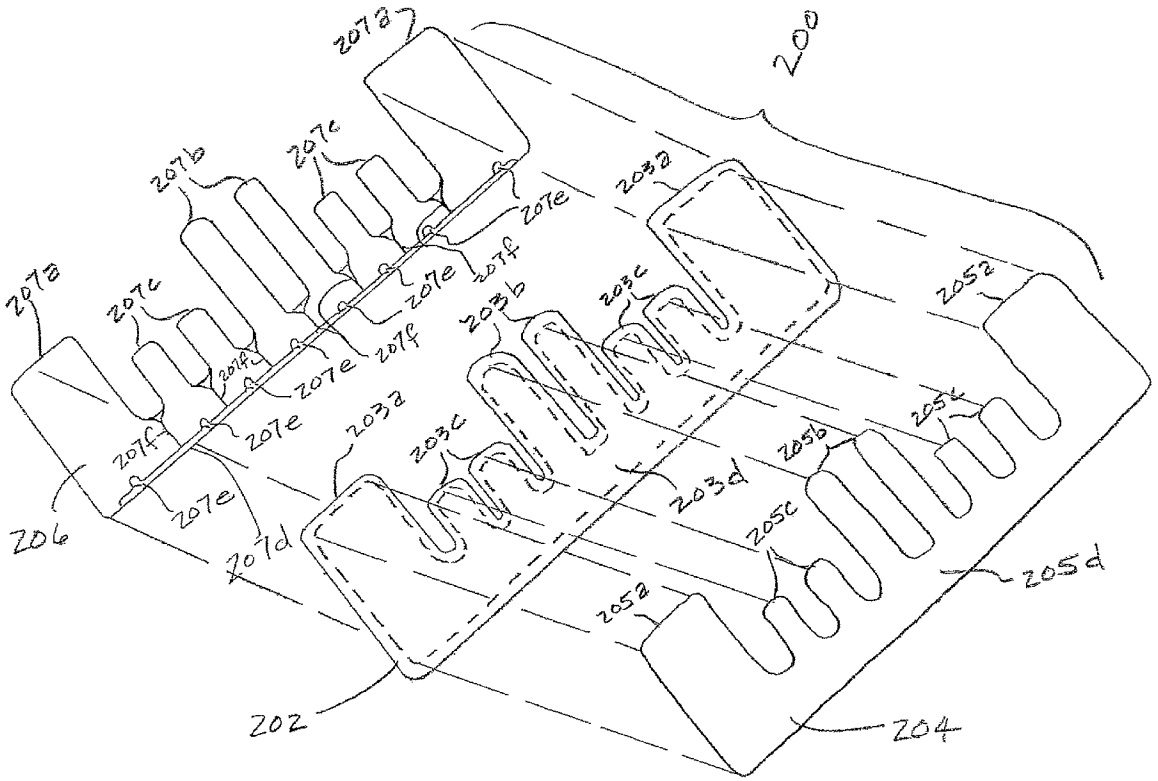
FIG. 7 is an exploded view of a dual section inflatable bladder for use in a personal floatation device in accordance with a third embodiment of the invention.
Figure 8:
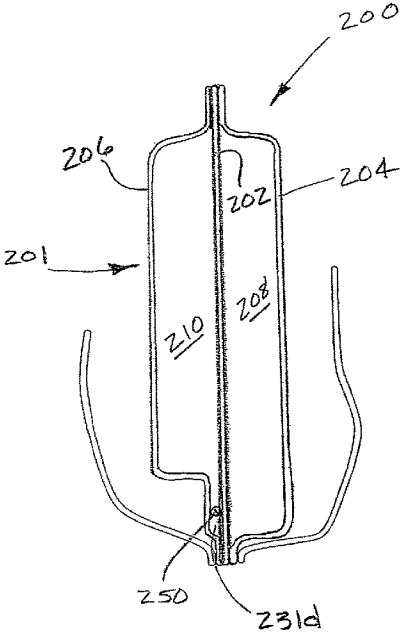
FIG. 8 is a sectional view, similar to FIG. 5 showing one of the dual section bladders in the inflated and deployed position extending from the personal floatation device.

Referring now to FIG. 7, there is illustrated a third embodiment of a personal floatation device, indicated generally at 200, in accordance with this invention. The a third embodiment of the personal floatation device 200 includes an inflatable dual section bladder assembly, indicated generally at 201 in FIGS. 8, 9, and 10. The dual section bladder assembly 201 includes a center wall section 202, a first bladder wall section 204, and a second bladder wall section 206. The illustrated center wall section 202 is slightly larger in size than the first and second wall sections 204 and 206, respectively, although such is not required. The first and second wall sections 204 and 206 are each attached, preferably at or near the outer edges, to opposite sides of the center wall section 202. The wall sections 202, 204, and 206 may be joined together at or near the outer edges by any suitable method in order to make a fluid tight seal. When attached, the wall sections 202, 204, and 206 provide a plurality of hollow bladder cavities, such as a first section bladder cavity 208 and a second section bladder cavity 210 as shown in FIG. 8. The illustrated center, first, and second wall sections 202, 204, and 206 are formed from a single piece of material, although such is not required.

Figure 9:
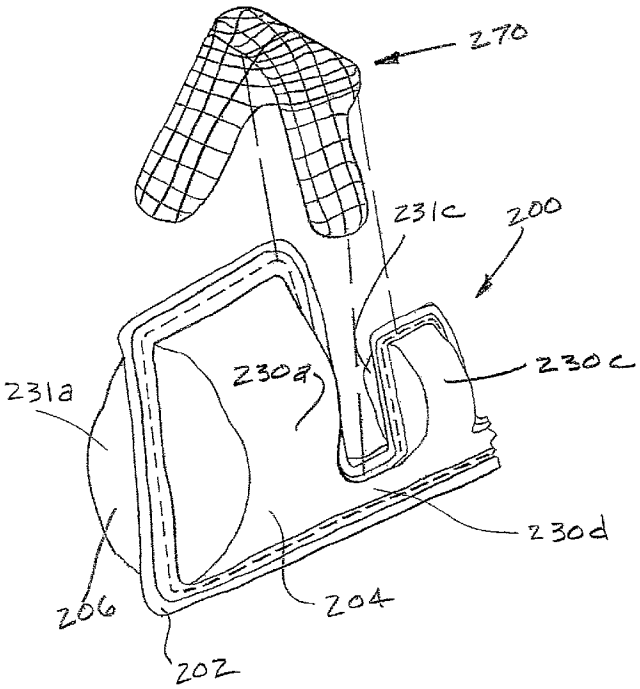
FIG. 9 is an exploded perspective view of a portion of the dual section bladder of FIG. 8 in a deployed and inflated condition and further showing a bladder containment web.
Figure 10:
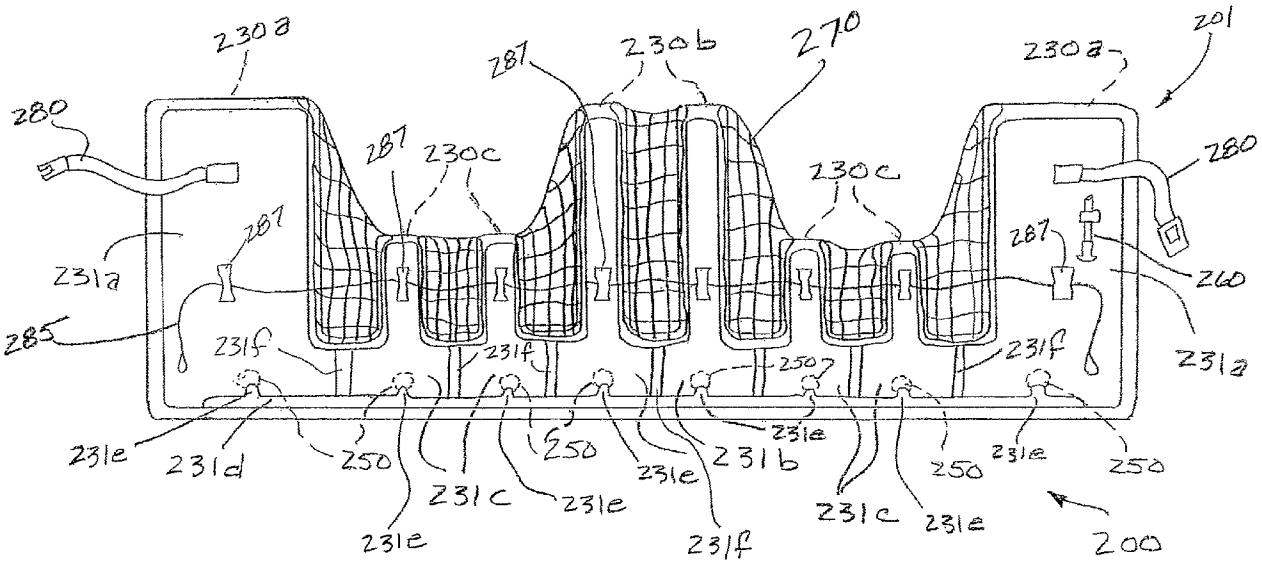
FIG. 10 is a side elevational view of the dual section bladder in a deployed and inflated condition and including a plurality of bladder containment webs disposed between adjacent bladder sections.

The center wall section 202 includes a plurality of extending portions 203*a*, 203*b*, and 203*c*, and a lateral section 203*d*. The first wall section 204 includes a plurality of extending portions 205*a*, 205*b*, and 205*c*, and a lateral section 205*d*. The extending portions 205*a*, 205*b*, and 205*c* cooperate with the corresponding extending portions of the center wall section 202 to form bladders 230*a*, 230*b*, and 230*c*, as shown in FIGS. 9 and 10. The purpose, heights, and relative arrangement of the bladders 230*a*, 230*b*, and 230*c* may be the same as those described above in conjunction with the personal floatation device 10. The lateral sections 203*d* and 205*d* cooperate to form a manifold 230*d*, shown in FIG. 9, between the center and first wall sections 202 and 204, respectively. The manifold 230*d* allows fluid communication between the bladders 230*a*, 230*b*, and 230*c*. The manifold 230*d* may be in fluid communication with the canister 135*a* to inflate the bladders 230*a*, 230*b*, and 230*c* when pull cord 136*a* is activated.

The second wall section 206 includes a plurality of extending portions 207*a*, 207*b*, and 207*c*, and a lateral channel 207*d*. The extending portions 207*a*, 207*b*, and 207*c* cooperate with the corresponding extending portions on the side of the center wall section 202 opposite to the first wall section 204. The cooperating extending portions 203*a* and 207*a*, 203*b* and 207*b*, and 203*c* and 207*c* form bladders 231*a*, 231*b*, and 231*c*. As shown in FIG. 7, the second wall section 206 further includes chamber separators 207*f* that are attached to the center wall section 202 in a fluid tight condition to form the inflatable bladders 231*a*, 231*b*, and 231*c* as discrete separate chambers. If desired, the inflatable bladders 231*a*, 231*b*, and 231*c* may be inflated in a generally simultaneous manner, similar to the first section described above. Once inflated, these separate bladders 231*a*, 231*b*, and 231*c* are independent and may be deflated individually. This separation of bladder chambers prevents all of the bladders 231*a*, 231*b*, and 231*c* from losing buoyancy should any one bladder deflate.

The lateral channel 207*d* engages a portion of the lateral section 203*d* of the center wall section 202 that is also on the side opposite the first wall section 204. The lateral channel 207*d* includes channel ports 207*e* that are adapted to provide fluid communication with the bladder cavities 210 of each of the bladders 231*a*, 231*b*, and 231*c*, when assembled. As shown in FIG. 10, the lateral channel 207*d* is sealed, preferably around the perimeter, to the lateral section 203*d* of the center wall section 202 to provide a fluid tight manifold channel 231*d*, shown in FIGS. 8 and 10. The sides of the lateral channel ports 207*e* are sealed to portions of the lateral section 203*d* to create a bladder port 231*e*. A bladder separation seam 231*f* is formed when the chamber separators 207*f* are sealed onto portions of the center wall section 202, as described above. The manifold channel 231*d* may be in fluid communication with the air canister 135*b* to inflate the bladders 231*a*, 231*b*, and 231*c* when pull cord 136*b* is activated.

A one-way check valve 250 engages each of the bladder ports 231*e* to provide one-way fluid communication with the bladders 231*a*, 231*b*, and 231*c*. The check valves 250 may be conventional in the art and may also provide the capability to selectively and independently deflate each bladder 231*a*, 231*b*, and 231*c* by the user after deployment. Alternatively, the lateral channel 207*d* and the channel ports 207*e* may be tubular components, positioned between the center and second wall sections 202 and 206 or along the outer surface of the second wall section 206, if desired. As shown in FIG. 10, a manual fill port 260 may be provided to inflate the bladders 230*a*, 230*b*, 230*c*, 231*a*, 231*b*, and 231*c*. The manual fill port 260 may be a pair of manual fill ports where one is in fluid communication with the manifold 230*d* and the other is in fluid communication with the manifold channel 231*d*. However, the manual fill port 260 may connected in any arrangement desired and may include a valve arrangement to selectively inflate the dual section bladder assembly 201.

Referring now to FIGS. 9 and 10, the personal floatation device 200 includes an interconnecting web, shown generally at 270. The interconnecting web 270 is preferably a flexible, elastic connection illustrated as a woven net disposed between adjacent dual bladders 230*a*, 231*a* and 230*c*, 231*c*, though such a configuration is not required. The interconnecting web 270 may be any flexible structure that maintains the general relative position of any adjacent dual bladder sections when the personal floatation device 200 is deployed and inflated. Furthermore, the interconnecting web 270 may be a single continuous structure that connects any number of the dual section bladders. The interconnecting web 270 is shown in FIG. 9 as being connected to the outer edge of the dual bladders 230*a*, 231*a* and 230*c*,231*c*, although such is not required. Rather, the interconnecting web 270 may connect to any portion of the dual section bladder assembly 201.

Referring again to FIG. 10, the dual section bladder assembly 201 may include a pair of cooperating bladder straps 280. The bladder straps 280 are shown in FIG. 10 as a pair of straps, each secured to the endmost bladders 231*a*, or alternatively bladders 230*a*. However, the bladder straps 280 may be secured to any of the bladders and may be any structure to secure the upper portions of the bladder assembly 201 together. The straps 280 may include fasteners, such as cooperating buckles or hook and loop fasteners, that are conventional in the art. The dual section bladder assembly 201 may also include a drawstring 285 that is supported on the bladders by loops 287. The drawstring 285 allows the bladder assembly 201 to accommodate users of various sizes by cinching the personal floatation device 200 at a midpoint of the bladder assembly 201. The drawstring 285 may be tightened after the bladder assembly is deployed to facilitate buoyant support of the user.

In accordance with the provisions of the patent statutes, the principle and mode of operation of this invention have been explained and illustrated in its preferred embodiments. However, it must be understood that this invention may be practiced otherwise than as specifically explained and illustrated without departing from its spirit or scope.

What is claimed is:

1. A personal floatation device comprising:

a housing adapted to be secured about a waist of a user; and a dual section bladder assembly secured to the housing and including a center wall section having first and second sides and a plurality of extending portions, a first wall section attached to the first side of the center wall section and including a plurality of extending portions that cooperate with the plurality of extending portions of the center wall section to define a first plurality of hollow bladder cavities, and a second wall section attached to the second side of the center wall section to define a second plurality of hollow bladder cavities, wherein the dual section bladder assembly is movable from a non-deployed position, wherein the dual section bladder assembly is disposed completely within the housing, to a deployed position, wherein the dual section bladder assembly extends outwardly from the housing.

2. The personal floatation device defined in claim 1 wherein the center wall section further includes a lateral section, and wherein the first wall section further includes a lateral section that cooperates with the lateral section of the center wall section to define a first manifold that communicates with each of the first plurality of hollow bladder cavities.

3. The personal floatation device defined in claim 2 wherein the center wall section includes a plurality of extending portions, and wherein the first wall section includes a plurality of extending portions that cooperate with the plurality of extending portions of the center wall section to define the first plurality of hollow bladder cavities.

4. The personal floatation device defined in claim 3 wherein the center wall section further includes a lateral section, and wherein the first wall section further includes a lateral section that cooperates with the lateral section of the center wall section to define a first manifold that communicates with each of the first plurality of hollow bladder cavities.

* * * * *